US008629810B2

(12) United States Patent
Hsieh et al.

(10) Patent No.: US 8,629,810 B2
(45) Date of Patent: Jan. 14, 2014

(54) MULTIBAND ANTENNA AND PORTABLE ELECTRONIC DEVICE USING THE SAME

(75) Inventors: Hsing-Yuan Hsieh, Shindian (TW); Jia-Ming Deng, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 793 days.

(21) Appl. No.: 12/821,266

(22) Filed: Jun. 23, 2010

(65) Prior Publication Data

US 2011/0215973 A1 Sep. 8, 2011

(30) Foreign Application Priority Data

Mar. 3, 2010 (CN) ..... 2010 1 0116921

(51) Int. Cl.
*H01Q 1/24* (2006.01)

(52) U.S. Cl.
USPC ..... 343/702; 343/700 MS

(58) Field of Classification Search
USPC ..... 343/702, 700 MS
See application file for complete search history.

(56) References Cited

U.S. PATENT DOCUMENTS 6,552,686 B2 * 4/2003 Ollikainen et al. .... 343/700 MS
7,821,469 B2 * 10/2010 Yu et al. ..... 343/828
7,847,753 B2 * 12/2010 Ishibashi et al. ..... 343/897

* cited by examiner

*Primary Examiner* — Hoang V Nguyen
*Assistant Examiner* — Kyana R McCain
(74) *Attorney, Agent, or Firm* — Altis Law Group, Inc.

(57) ABSTRACT

A multiband antenna includes a first radiating unit, a second radiating unit connected to the first radiating unit and including a first radiating arm, a second radiating arm, and a third radiating arm, and a connecting unit connected to the first radiating unit. The first radiating unit, the second radiating unit, and the connecting unit are all planar sheets positioned coplanar with each other. The first radiating unit is a sector having a first radii side, a second radii side and an arc side. The first radiating arm, the second radiating arm, and the connecting unit are connected to the first radii side, and the third radiating arm is connected to the second radii side.

19 Claims, 3 Drawing Sheets

MULTIBAND ANTENNA AND PORTABLE ELECTRONIC DEVICE USING THE SAME

BACKGROUND

1. Technical Field

The present disclosure relates to antennas and portable electronic devices using the same, and particularly to a multiband antenna and a portable electronic device using the same.

2. Description of Related Art

Many portable electronic devices, such as mobile phones, personal digital assistants (PDA) and laptop computers, have antennas mounted therein for receiving/sending wireless signals. Commonly, a portable electronic device may receive/send wireless signals of different frequencies, which requires its antenna be a multiband antenna.

Generally, multiband antennas have complicated structures and are difficult to be miniaturized. Furthermore once miniaturized, multiband antennas are difficult to be precisely installed in portable electronic devices. Thus, communication quality of the portable electronic devices using the multiband antennas may be adversely affected.

Therefore, there is room for improvement within the art.

BRIEF DESCRIPTION OF THE DRAWINGS

Many aspects of the present multiband antenna and portable electronic device using the same can be better understood with reference to the following drawings. The components in the various drawings are not necessarily drawn to scale, the emphasis instead being placed upon clearly illustrating the principles of the present multiband antenna and portable electronic device using the same. Moreover, in the drawings, like reference numerals designate corresponding parts throughout the figures.

DETAILED DESCRIPTION

Figure 1:
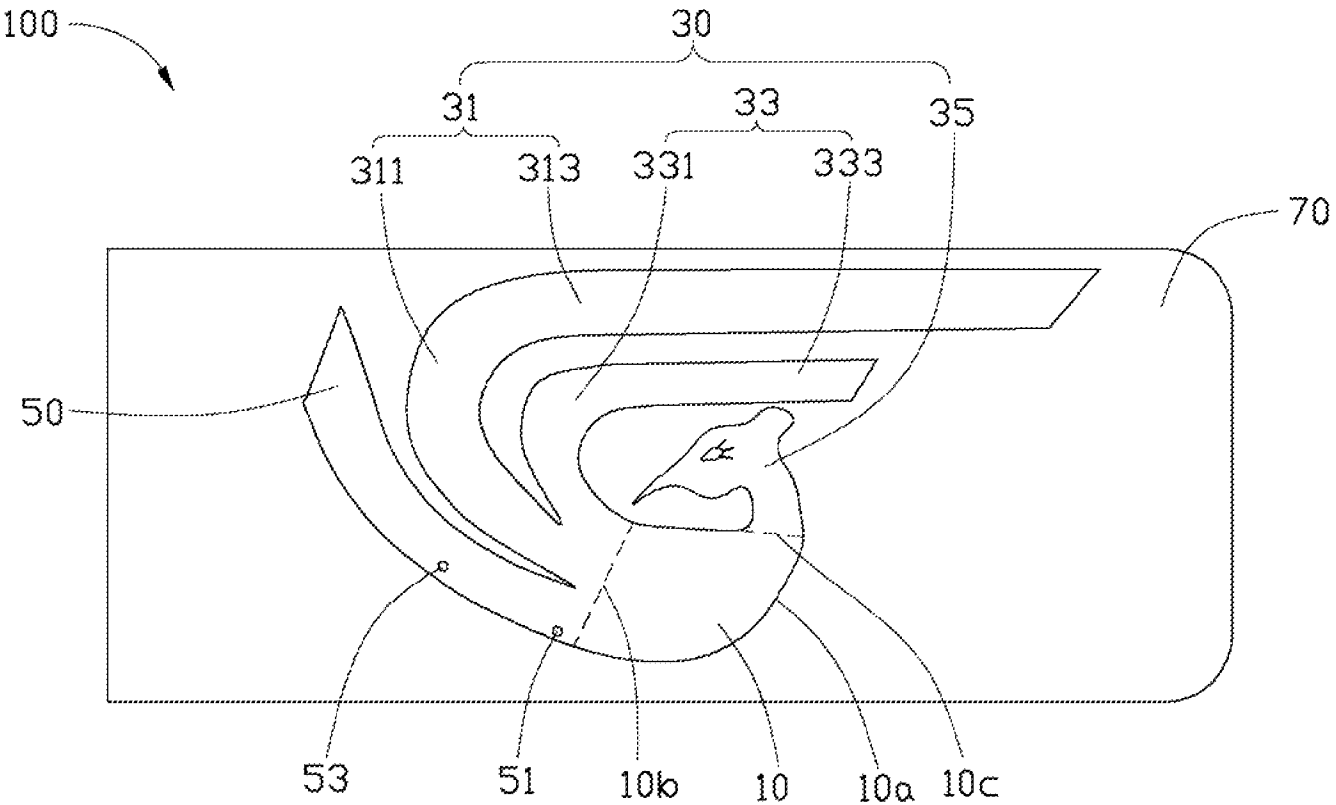
FIG. 1 is a schematic view of a multiband antenna, according to an exemplary embodiment.
Figure 2:
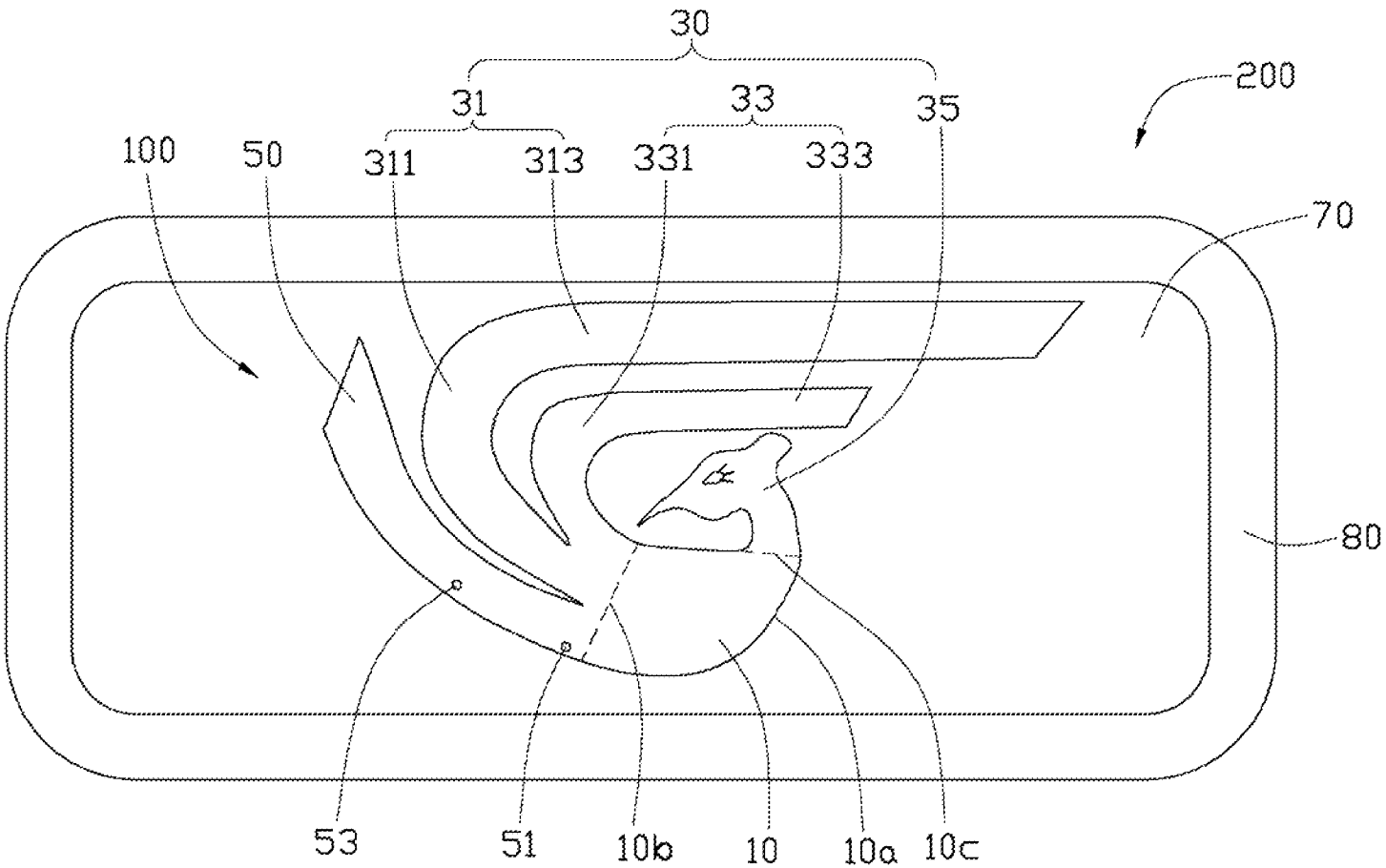
FIG. 2 is a schematic view of a portable electronic device, according to another embodiment.

FIG. 1 shows a multiband antenna 100 according to an exemplary embodiment. FIG. 2 shows a portable electronic device 200 according to an exemplary embodiment. The portable electronic device 200 includes a housing 80, and the multiband antenna 100 is mounted on the housing 80 and electrically connected to inner circuitry (not shown) of the portable electronic device 200 to receive/send wireless signals when the portable electronic device 200 is used.

The multiband antenna 100 is a planar antenna. The multiband antenna 100 includes a first radiating unit 10, a second radiating unit 30, a connecting unit 50, and a substrate 70. The first radiating unit 10, the second radiating unit 30, and the connecting unit 50 are all planar sheets made of conductive materials, and are positioned coplanar with each other. The substrate 70 is a planar board made of insulating materials, and can be a part of the housing 80. The first radiating unit 10, the second radiating unit 30, and the connecting unit 50 are all attached to a same surface of the substrate 70, and the first radiating unit 10, the second radiating unit 30, and the connecting unit 50 are configured to have decorative shapes, such as birds, animals, or logos. The second radiating unit 30 and the connecting unit 50 are both connected to the first radiating unit 10.

The first radiating unit 10 is an approximate sector, which forms the body that represents the shape of a bird. The first radiating unit 10 has an arc side 10*a*, a first radii side 10*b*, and a second radii side 10*c*. The second radiating unit 30 includes a first radiating arm 31, a second radiating arm 33, and a third radiating arm 35. The first radiating arm 31, the second radiating arm 33, and the connecting unit 50 are connected to the first radii side 10*b* and form the tail of the bird shape. The third radiating arm 35 is connected to the second radii side 10*c* and forms the head of the bird shape.

The first radiating arm 31 includes a first arc portion 311 and a first straight portion 313. One end of the first arc portion 311 is connected to a middle portion of the first radii side 10*b*. The first arc portion 311 first extends away from the first radiating unit 10, and then bends back to extend substantially parallel to the second radii side 10*c*. The first straight portion 312 is connected to another end of the first arc portion 311 and extends substantially parallel to the second radii side 10*c*.

The second radiating arm 33 is shorter than the first radiating arm 31. The second radiating arm 33 includes a second arc portion 331 and a second straight portion 333. One end of the second arc portion 331 is connected to an end of the first radii side 10*b* that is adjacent to the second radii side 10*c*. Similar to the first arc portion 311, the second arc portion 331 first extends away from the first radiating unit 10, and then bends back to extend substantially parallel to the second radii side 10*c*. The second straight portion 333 is connected to another end of the second arc portion 331 and extends substantially parallel to the second radii side 10*c*. Thus, the second straight portion 333 is positioned between the first straight portion 313 and the second radii side 10*c* of the first radiating unit 10. The second straight portion 333 is shorter than the first straight portion 313.

The third radiating arm 35 is connected to an end of the second radii side 10*c* that is adjacent to the arc side 10*a*, and is positioned between the second straight portion 333 and the second radii side 10*c* of the first radiating unit 10. The third radiating arm 35 is shaped to represent to a bird's head for the purpose of decoration. The third radiating arm 35 is shorter than the first radiating arm 31 and the second radiating arm 33.

The connecting unit 50 is an arc-shaped sheet. One end of the connecting unit 50 is connected to an end of the first radii side 10*b* that is adjacent to the arc side 10*a*. The connecting unit 50 extends substantially parallel to the first arc portion 311. A feed connector 51 and a ground connector 53 are formed on the connecting unit 50, wherein the feed connector 51 is positioned closer to the first radiating unit 10 than the ground connector 53.

In use, the multiband antenna 100 is connected to the inner circuitry of the portable electronic device 200 via the feed connector 51 and the ground connector 53. Feed signals can be input to the multiband antenna 100 through the feed connector 51. The input feed signals can first pass through the first radiating unit 10, and then respectively pass through the first radiating arm 31, the second radiating arm 33, and the third radiating arm 35. Thus, the first radiating arm 31, the second radiating arm 33, and the third radiating arm 35 can respectively receive/send signals at different frequencies due to their different circuit lengths.

Figure 3:
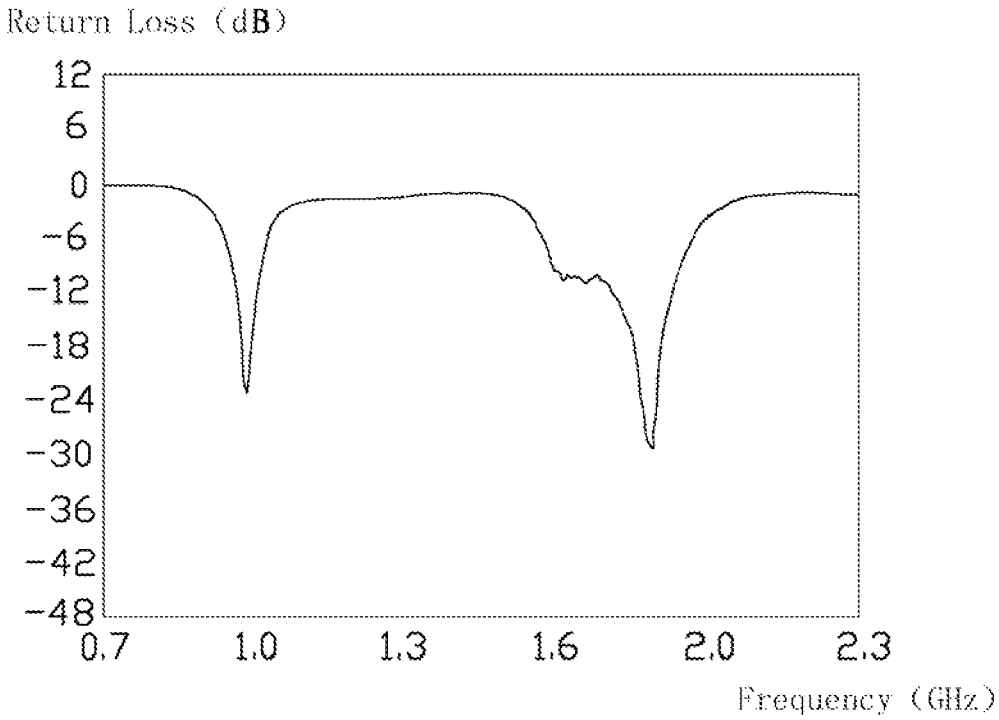
FIG. 3 is a diagram of return loss (RL) of the multiband antenna shown in FIG. 1.

Referring to FIG. 3, as determined from testing, in a frequency band of about 0.85 GHz-1.15 GHz, the return loss (RL) of the multiband antenna 100 is less than −3 dB. In a frequency band of about 1.65 GHz-2.10 GHz, the RL of the multiband antenna 100 is less than −6 dB. Therefore, the multiband antenna 100 can be used in a plurality of wireless communication systems having different working frequencies, such as GSM900 (i.e., at working frequencies of about 0.9 GHz), GSM 1800 (i.e., at working frequencies of about 1.8 GHz), and GSM 1900 (i.e., at working frequencies of about 1.9 GHz).

In fabrication, the multiband antenna 100 can also be made of a single planar sheet, and different parts of the sheet can respectively serve as the first radiating unit 10, the second radiating unit 30, and the connecting unit 50. Since the first radiating unit 10, the second radiating unit 30, and the connecting unit 50 are all planar sheets and are positioned coplanar with each other, the multiband antenna 100 does not need much space, which is convenient for the miniaturization of portable electronic devices using the multiband antenna 100.

In the present disclosure, the substrate 70 is used as a part of the housing 80, and the first radiating unit 10, the second radiating unit 30, and the third radiating unit 50 are positioned on an outside surface of the housing 80, as shown in FIG. 2. Thus, the shapes of the first radiating unit 10, the second radiating unit 30, and the third radiating unit 50 that cooperatively represent a bird can decorate the portable electronic device 200. Alternatively, the first radiating unit 10, the second radiating unit 30, and the third radiating unit 50 can also be positioned on an inside surface of the housing 80, and the substrate 70 is configured to be transparent. Thus, the first radiating unit 10, the second radiating unit 30, and the connecting unit 50 can be better protected, and can still decorate the portable electronic device 200.

Furthermore, if the impedance of the third radiating arm 35 is maintained, the third radiating arm 35 can be shaped to represent other designs, such as heads of other animals, or predetermined logos.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A multiband antenna, comprising:

a first radiating unit;

a second radiating unit connected to the first radiating unit, the second radiating unit including a first radiating arm, a second radiating arm, and a third radiating arm; and a connecting unit connected to the first radiating unit; wherein the first radiating unit, the second radiating unit, and the connecting unit are all planar sheets positioned coplanar with each other; the first radiating unit is a sector having a first radii side, a second radii side and an arc side; the first radiating arm, the second radiating arm, and the connecting unit are connected to the first radii side and form a bird's tail shape, and the third radiating arm is connected to the second radii side and forms a bird's head shape.

2. The multiband antenna as claimed in claim 1, wherein the connecting unit includes a feed connector configured to input feed signals to the multiband antenna and a ground connector, and the feed connector is positioned closer to the first radiating unit than the ground connector.

3. The multiband antenna as claimed in claim 2, wherein the first radiating arm includes a first arc portion and a first straight portion; one end of the first arc portion is connected to a middle portion of the first radii side, the first arc portion first extends away from the first radiating unit and then bends back to extend parallel to the second radii side, the first straight portion is connected to another end of the first arc portion and extends parallel to the second radii side.

4. The multiband antenna as claimed in claim 3, wherein the second radiating arm includes a second arc portion and a second straight portion; one end of the second arc portion is connected to an end of the first radii side that is adjacent to the second radii side, the second arc portion first extends away from the first radiating unit and then bends back to extend parallel to the second radii side; the second straight portion is connected to another end of the second arc portion and extends parallel to the second radii side, such that the second straight portion is positioned between the first straight portion and the second radii side.

5. The multiband antenna as claimed in claim 4, wherein the second straight portion is shorter than the first straight portion.

6. The multiband antenna as claimed in claim 4, wherein the third radiating arm is connected to an end of the second radii side that is adjacent to the arc side, and is positioned between the second straight portion and the second radii side.

7. The multiband antenna as claimed in claim 6, wherein the connecting unit is an arc-shaped sheet, one end of the connecting unit is connected to an end of the first radii side that is adjacent to the arc side, and the connecting unit extends parallel to the first arc portion.

8. The multiband antenna as claimed in claim 1, wherein the second radiating arm is shorter than the first radiating arm, and the third radiating arm is shorter than the second radiating arm; when input feed signals pass through the first radiating arm, the second radiating arm, and the third radiating arm, the first radiating arm, the second radiating arm, and the third radiating arm respectively receive/send signals at different frequencies due to their different circuit lengths.

9. The multiband antenna as claimed in claim 1, further comprising a substrate, wherein the substrate is a planar board, and the first radiating unit, the second radiating unit, and the third radiating unit are all attached on a same surface of the substrate.

10. The multiband antenna as claimed in claim 9, wherein the substrate is transparent.

11. A portable electronic device, comprising:

a housing; and a multiband antenna mounted on the housing; wherein the multiband antenna includes a first radiating unit, a second radiating unit, a connecting unit, and a substrate;

the substrate is used as a part of the housing, the first radiating unit, the second radiating unit, and the connecting unit are all planar sheets positioned coplanar with each other and have a decorative shape of a bird, the first radiating unit, the second radiating unit, and the connecting unit are attached on a same surface of the substrate.

12. The portable electronic device as claimed in claim 11, wherein the first radiating unit, the second radiating unit, and the connecting unit are positioned on an outside surface of the housing.

13. The portable electronic device as claimed in claim 11, wherein the first radiating unit, the second radiating unit, and the connecting unit are positioned on an inside surface of the housing, and the substrate is transparent.

14. A multiband antenna, comprising:

a first radiating unit;

a second radiating unit connected to the first radiating unit, the second radiating unit including a first radiating arm, a second radiating arm, and a third radiating arm; and a connecting unit connected to the first radiating unit; wherein the first radiating unit, the second radiating unit, and the connecting unit are all planar sheets positioned coplanar with each other and have a decorative shape of a bird.

15. A multiband antenna, comprising:

a first radiating unit;

a second radiating unit connected to the first radiating unit, the second radiating unit including a first radiating arm, a second radiating arm, and a third radiating arm; and a connecting unit connected to the first radiating unit; wherein the first radiating unit, the second radiating unit, and the connecting unit are all planar sheets positioned coplanar with each other; the first radiating unit is a sector having a first radii side, a second radii side and an arc side; the first radiating arm and the second radiating arm are connected to the first radii side, the third radiating arm is connected to the second radii side, the connecting unit is an arc-shaped sheet, one end of the connecting unit is connected to an end of the first radii side that is adjacent to the arc side, the connecting unit first extends away from the first radiating unit and then bends back to extend parallel to the second radii side.

16. The multiband antenna as claimed in claim 15, wherein the connecting unit includes a feed connector configured to input feed signals to the multiband antenna and a ground connector, and the feed connector is positioned closer to the first radiating unit than the ground connector.

17. The multiband antenna as claimed in claim 15, wherein the first radiating arm includes a first arc portion and a first straight portion; one end of the first arc portion is connected to a middle portion of the first radii side, and the first arc portion extends parallel to the connecting unit, the first straight portion is connected to another end of the first arc portion and extends parallel to the second radii side.

18. The multiband antenna as claimed in claim 17, wherein the second radiating arm includes a second arc portion and a second straight portion; one end of the second arc portion is connected to an end of the first radii side that is adjacent to the second radii side, the second arc portion first extends away from the first radiating unit and then bends back to extend parallel to the second radii side; the second straight portion is connected to another end of the second arc portion and extends parallel to the second radii side, such that the second straight portion is positioned between the first straight portion and the second radii side.

19. The multiband antenna as claimed in claim 18, wherein the third radiating arm is connected to an end of the second radii side that is adjacent to the arc side, and is positioned between the second straight portion and the second radii side.

* * * * *